US012808643B2

(12) United States Patent
Meyer et al.

(10) Patent No.: US 12,808,643 B2
(45) Date of Patent: Nov. 24, 2026

(54) MIXED BLASTING SYSTEM

(71) Applicant: DETNET SOUTH AFRICA (PTY) LTD, Johannesburg (ZA)

(72) Inventors: Tielman Christiaan Meyer, Johannesburg (ZA); Johannes Nicholaas Gerhardus Swart, Mindarie (AU)

(73) Assignee: DETNET SOUTH AFRICA (PTY) LTD, Johannesburg (ZA)

( * ) Notice: Subject to any disclaimer, the term of this patent is extended or adjusted under 35 U.S.C. 154(b) by 0 days.

(21) Appl. No.: 19/152,573

(22) PCT Filed: Jan. 24, 2024

(86) PCT No.: PCT/ZA2024/050004

§ 371 (c)(1),
(2) Date: Jul. 31, 2025

(87) PCT Pub. No.: WO2024/164032

PCT Pub. Date: Aug. 8, 2024

(65) Prior Publication Data

US 2026/0227166 A1 Aug. 6, 2026

(30) Foreign Application Priority Data

Feb. 2, 2023 (ZA) ..... 2023/01328

(51) Int. Cl.
*F42D 1/055* (2006.01)

(52) U.S. Cl.
CPC ..... *F42D 1/055* (2013.01)

(58) Field of Classification Search
None
See application file for complete search history.

(56) References Cited

U.S. PATENT DOCUMENTS 4,674,047 A * 6/1987 Tyler ..... F42D 1/055 102/206
8,474,379 B2 * 7/2013 Jacobson ..... F42D 3/04 102/311

(Continued)

FOREIGN PATENT DOCUMENTS

WO 03/029748 A1 4/2003
ZA 200 004 542 B 5/2001

OTHER PUBLICATIONS

International Search Report mailed Apr. 19, 2024 for International Patent Application No. PCT/ZA2024/050004 (3 pages).

(Continued)

*Primary Examiner* — Derrick R Morgan
(74) *Attorney, Agent, or Firm* — Smith, Gambrell & Russell, LLP

(57) ABSTRACT

A mixed blasting system which includes a master blast controller, a first controller which is in signal communication with the master blast controller, a plurality of wired detonators which are in wired communication with the first controller, at least one of the wired detonators including a memory module for storing an identifier, a second controller which is in signal communication with the master blast controller, and a transmitter and antenna arrangement which is under the control of the second controller and which is in communication with a plurality of wireless detonators each of which includes a respective memory module for storing an identifier.

7 Claims, 1 Drawing Sheet

(56) References Cited

U.S. PATENT DOCUMENTS

| | | | | |
|---|---|---|---|---|
| 9,658,045 | B2 * | 5/2017 | Kruger | F42D 3/04 |
| 10,295,323 | B2 * | 5/2019 | Kotsonis | F42D 1/05 |
| 10,429,162 | B2 * | 10/2019 | Papillon | F42D 5/00 |
| 12,098,910 | B2 * | 9/2024 | Uchida | F42D 1/045 |
| 2008/0041261 | A1 * | 2/2008 | Hummel | F42D 1/05 102/262 |
| 2015/0007740 | A1 * | 1/2015 | Guyon | F42D 1/055 102/215 |
| 2016/0218863 | A1 | 7/2016 | Schlenter et al. | |
| 2021/0318107 | A1 * | 10/2021 | Maurissens | F42D 3/04 |

OTHER PUBLICATIONS

Written Opinion of the International Searching Authority mailed Apr. 19, 2024 International Patent Application No. PCT/ZA2024/050004 (6 pages).

International Preliminary Report on Patentability mailed Sep. 4, 2024 International Patent Application No. PCT/ZA2024/050004 (6 pages).

* cited by examiner

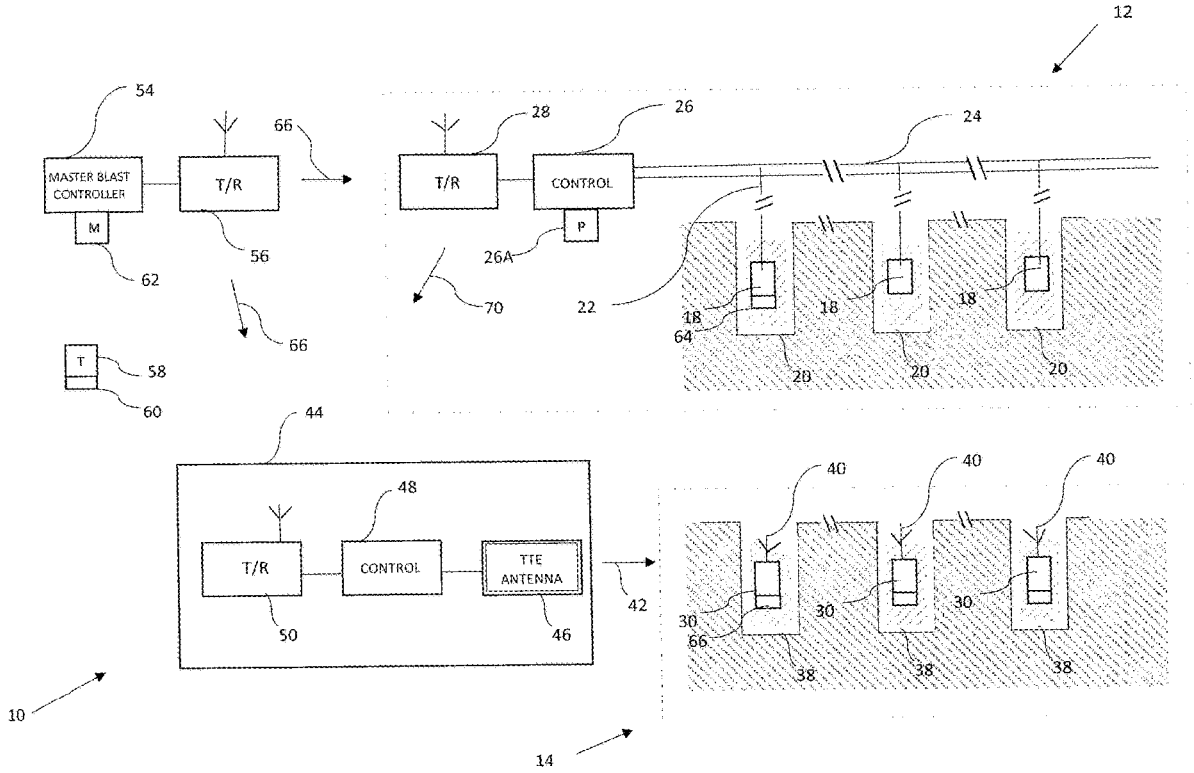
12
54
MASTER BLAST CONTROLLER
M
62
T/R
56
66
T
58
60
66
28
T/R
26
CONTROL
P
26A
70
24
22
18
64
20
44
T/R
48
CONTROL
TTE ANTENNA
50
46
42
40
30
66
38
10
14

MIXED BLASTING SYSTEM

BACKGROUND OF THE INVENTION

This invention relates to a mixed or hybrid blasting system i.e. to a system which uses wired detonators and wireless detonators.

Wireless detonators are more expensive than wired detonators. Typically, particularly on surface applications, wireless detonators are used in high risk areas such as those areas with unstable ground. Wireless detonators can also be used in an area which has been excavated and which has at least one wall which, if not properly reinforced, could present a danger to an operator who is installing the detonators.

The use of wireless detonators allows operator exposure to be reduced as an operator typically only needs to visit a location in which a wireless detonator is to be installed once, to properly set up the wireless detonator. A drawback of a wireless detonator is that communication with the detonator is uni-directional, for the wireless detonator does not have sufficient on-board energy to transmit a return signal, through rock, to a blast controller.

In contrast, wired detonators are relatively inexpensive and are used in areas which are generally considered to be safe. An operator typically has to visit each wired detonator more than once to properly set up the wired detonator. A benefit of a wired detonator system is that bi-directional communication takes place between each detonator and a blast controller. This capability allows for functional and operational aspects of each wired detonator to be monitored and controlled.

An object of this invention is to provide a mixed blasting system which includes wired detonators and wireless detonators. One problem which must be addressed though is that an arrangement is required which allows for synchronized firing of the wired, and of the wireless, detonators. Another problem, particularly on surface applications, is that an envelope of a signal from a wireless transmitter which is intended for use at a first blast site, can extend to a second blast site. This can cause inadvertent firing of detonators which are installed at the second blast site. This poses a significant safety concern in that operators might, at the time, be installing blast equipment at the second site.

The invention is concerned with the aforementioned situation.

SUMMARY OF THE INVENTION

The invention provides a mixed blasting system which includes a master blast controller, a first controller which is in signal communication with the master blast controller, a plurality of wired detonators which are in wired communication with the first controller, at least one of the wired detonators including a memory module for storing an identifier, a second controller which is in signal communication with the master blast controller, and a transmitter and antenna arrangement which is under the control of the second controller and which is in communication with a plurality of wireless detonators each of which includes a respective memory module for storing an identifier.

The first controller may include a processor module which is configured to perform a verification process to allow blasting of all the detonators only if a control identifier which is communicated from the master blast controller corresponds with an identifier which is stored in the memory module of the at least one wired detonator, and if an identifier which is stored in the respective memory module of each wireless detonator corresponds with the control identifier which is received from the transmitter and antenna arrangement.

In the mixed blasting system use may be made of at least one tagger unit with a memory module in which an identifier which is pre-programmed is stored and which is configured to tag the at least one wired detonator and the wireless detonators thereby to store the identifier in the respective memory modules.

The tagger unit may be configured to tag the master blast controller thereby to store the identifier, which is to be communicated as the control identifier to the first and second controllers, in a memory module of the master blast controller. This ensures that the same identifier, is stored in the respective memory modules of the detonators and of the master blast controller. The detonators can then be fired in unison, upon completion of the verification process, under the control of the master blast controller. Additionally a safe guard in the form of the identifier is provided which helps to ensure that the detonators in a second mixed blasting system at an adjacent second blast site, in which a corresponding identifier is not stored, are not inadvertently fired.

The master blast controller is preferably operable to transmit a verification signal which includes the control identifier to the first controller and to the second controller.

The processor module of the first controller may be configured to compare the identifier in the memory module of the at least one wired detonator to the control identifier in the verification signal and, if the identifiers match, of initiating the transmission, directly or indirectly, of a confirmatory signal to the second controller which is configured to communicate the verification signal to the wireless detonators only if the confirmatory signal indicates that the identifiers match. This allows the wireless detonators to be linked to the at least one wired detonator, through the use of an identifier which is stored in the at least one wired detonator.

The control identifier may be a communication encryption key (CEK). The master blast controller is preferably operable to transmit a verification signal which includes the CEK and a cyclic redundancy check (CRC) to the first controller and to the second controller. The processor module of the first controller may be configured by using the CRC, to determine whether the correct CEK, has been received. The second controller, in response to receiving the verification signal may communicate, via the transmitter and antenna arrangement, the verification signal to the wireless detonators each of which is configured to determine whether the correct CEK has been received. For firing of all the detonators to take place the identifier (CEK) of the wireless detonators must match the received control identifier (CEK), and the identifier of the at least one wired detonator must match the control identifier (CEK) received at the first controller.

The second controller may communicate with the wireless detonators using through-the-earth signals at an appropriate frequency. Normally these signals are unidirectional i.e. the wireless detonators are not capable of transmitting signals in the return direction to the second controller. The first controller, in response to a fire signal from the master blast controller, may transmit a fire signal to the wired detonators once a predetermined time interval has passed. The duration of the time interval must allow for a fire signal (which is a through-the-earth (TTE) signal) to reach and to cause initiation of the wireless detonators, after the second controller receives a fire signal from the master blast controller. This sequence allows the wireless detonators to be fired in synchronism with the wired detonators.

BRIEF DESCRIPTION OF THE DRAWING

The invention is further described by way of example with reference to the accompanying drawing which illustrates in block diagram form a mixed blasting system according to the invention.

DESCRIPTION OF PREFERRED EMBODIMENT

The accompanying drawing illustrates a mixed blasting system 10 according to the invention which includes a first arrangement 12 of wired detonators and a second arrangement 14 of wireless detonators.

The first arrangement 12 includes wired detonators 18 which are positioned in respective boreholes 20 and which are connected by respective branch lines 22 to a wired harness 24.

The harness 24 is connected to a first controller 26 which includes a processor module 26A and which is in communication with a transmitter/receiver 28.

The second arrangement 14 includes a plurality of wireless detonators 30 which are positioned in respective boreholes 38. Each wireless detonator 30 has a respective antenna 40 which is responsive to a through-the-earth signal 42 which is transmitted from a transmitter and antenna arrangement 44 which includes an appropriate antenna 46 under the control of a second controller 48 which is in communication with a transmitter/receiver 50.

Blasting is controlled by means of a master blast controller 54 which is connected to a transmitter/receiver 56 and which can communicate using wireless signals with the transmitter/receiver 28 and with the transmitter/receiver 50.

In the mixed blasting system 10 the second arrangement 14 of the wireless detonators 30 is typically used in a high risk area such as an area with unstable ground or near a high wall.

The first arrangement 12 of wired detonators on the other hand is used in areas which are regarded as relatively low risk areas.

The invention is concerned with ensuring that the correct wireless detonators 30 are fired in conjunction with the correct wired detonators 18 and that such firing takes place in a synchronized manner. To achieve this the wireless detonators 30 are tagged with the same identifier in the form of a communication encryption key (CEK) or cyclic redundancy check (CRC). Also, at least one of the wired detonators 18 is tagged with the same CEK or, more preferably, a CRC of the same CEK. Preferably an end of line detonator is tagged. It is also preferred to tag the detonators at opposed ends of the harness. The master blast controller 54 is also tagged is a similar manner. Tagging takes place through the use of a tagger unit 58 which includes a memory module 60 in which is stored the identifier, by transferring the identifier to respective memory modules 62, 64, 66 of the master blast controller 54, the wired detonators 18 and the wireless detonators 30. When blasting is to take place the blast controller 54 sends a verification signal 66 which includes a control identifier i.e. the identifier stored in the memory module 62 (the CEK or the CRC as the case may be) to the first controller 26 and the second controller 48. The first controller 26 then interrogates the wired detonators 18 that have been previously tagged with an identifier. If the tagged identifier is matched to the transmitted and received control identifier then all the wired detonators 18, on the harness 24, can be fired. The wireless detonators 30 can be fired in response to a confirmatory signal 70 which is sent by the first controller 26 via the transmitter/receiver 28, upon verification that the identifier stored in the memory module 64 of the at least one wired detonator 18 corresponds with the control identifier, to the second controller 48 and if the identifier stored in the respective memory modules 66 of the wireless detonators correspond with the control identifier. If there is a mismatch the blast is not allowed.

To allow for firing of the first arrangement of wired detonators 12 to be synchronised with firing of the second arrangement of wireless detonators 14, the first controller 26 executes a timing interval of a predetermined duration upon receiving a fire signal from the master blast controller 54. During this interval a fire signal is transmitted from the second controller 48 via the antenna 46, through the earth, to the wireless detonators 30. The transmission of the through-the-earth signal 42 takes longer than the transmission of the fire signal on the harness 24. The delay allows the fire signal to the detonators 18 to be synchronised with the fire signal to the detonators 30.

The firing technique referred to ensures that detonation (wired and wireless) at an adjacent blast site cannot inadvertently be fired in response to the fire signal from the master blast controller 54 for only the wired detonators 18 which are linked by the harness 24 to the at least one wired detonator 18 which has been tagged with the CEK or CRC, and the wireless detonators 30 which have initially been tagged with the same CEK or CRC, can be fired.

The invention claimed is:

1. A mixed blasting system, comprising:

a master blast controller, a first controller in signal communication with the master blast controller, a plurality of wired detonators in wired communication with the first controller, at least one of the wired detonators including a memory module for storing an identifier, a second controller in signal communication with the master blast controller, and a transmitter and antenna arrangement under control of the second controller and in communication with a plurality of wireless detonators each of which includes a respective memory module for storing an identifier, wherein the first controller includes a processor module configured to perform a verification process to allow blasting of all the detonators only if a control identifier communicated from the master blast controller corresponds with the identifier stored in the memory module of the at least one wired detonator, and if the identifier stored in the respective memory module of each wireless detonator corresponds with the control identifier received from the transmitter and antenna arrangement, and the first controller, in response to a fire signal from the master blast controller, transmits a fire signal to the wired detonators upon completion of a time interval with a predetermined duration, and the second controller, in response to a fire signal from the master blast controller, transmits a through-the-earth (TTE) fire signal to the wireless detonators, wherein the duration of the time interval is sufficient to allow the TTE fire signal to reach and to cause initiation of the wireless detonators in synchronism with initiation of the wired detonators.

2. A mixed blasting system according to claim 1, further comprising:

at least one tagger unit with a memory module storing a pre-programmed identifier, the tagger unit configured to tag the at least one wired detonator and the wireless detonators thereby to store the respective identifiers in the respective memory modules of the detonators.

3. A mixed blasting system according to claim 2, wherein the tagger unit is configured to tag the master blast controller thereby to store the identifier, which is to be communicated as the control identifier to the first and second controllers, in a memory module of the master blast controller.

4. A mixed blasting system according to claim 1, wherein the master blast controller is operable to transmit a verification signal which includes the control identifier to the first controller and to the second controller.

5. A mixed blasting system according to claim 4, wherein the processor module of the first controller is configured to compare the identifier in the memory module of the at least one wired detonator to the control identifier in the verification signal and, if the identifiers match, initiate transmission of a confirmatory signal to the second controller which is configured to communicate the verification signal to the wireless detonators only if the confirmatory signal indicates that the identifiers match.

6. A mixed blasting system according to claim 5, wherein the verification signal includes the control identifier in the form of a communication encryption key (CEK) and a cyclic redundancy check (CRC) to the first controller and to the second controller.

7. A mixed blasting system according to claim 6, wherein the processor module of the first controller is configured to use the CRC to determine whether the correct CEK has been received, and the second controller is configured, in response to receiving the verification signal, to communicate, via the transmitter and antenna arrangement, the verification signal to the wireless detonators each of which is configured to determine whether the correct CEK has been received.

* * * * *